US006148741A

United States Patent [19]

Motta

[11] Patent Number: 6,148,741

[45] Date of Patent: Nov. 21, 2000

[54] TABLE WITH ADJUSTABLE TABLE TOP PORTIONS

[75] Inventor: Giuseppe Motta, Bellagio, Italy

[73] Assignee: UNIFOR S.p.A., Turate, Italy

[21] Appl. No.: 09/193,526

[22] Filed: Nov. 17, 1998

[30] Foreign Application Priority Data

Nov. 25, 1997 [IT] Italy ..... MI97A 2601

[51] Int. Cl.[7] ..... A47B 57/00

[52] U.S. Cl. ..... 108/96; 108/147

[58] Field of Search ..... 108/147, 106, 108/147.19, 147.21, 96, 95

[56] References Cited

U.S. PATENT DOCUMENTS

| | | | |
|---|---|---|---|
| 2,368,748 | 2/1945 | Doty | 108/147 |
| 4,593,874 | 6/1986 | Dunagan | 108/147 |
| 5,271,320 | 12/1993 | Reneau | 108/96 |

FOREIGN PATENT DOCUMENTS

| | | | |
|---|---|---|---|
| 632297 | 12/1992 | Australia | 108/147 |

*Primary Examiner*—Peter M. Cuomo
*Assistant Examiner*—Jerry A. Anderson
*Attorney, Agent, or Firm*—Wolf, Greenfield & Sacks, P.C.; James H. Morris

[57] ABSTRACT

The table has a table top portion (A) intended for use as a working surface and a table top portion (B) intended for use as an additional supporting surface. The two table top portions (A,B) are adjustable in height conjointly or separately. The vertical member for supporting the table top comprises at least two tubular members arranged one into the other so as to be axially movable relative to each other, drive means adapted to impart an axial motion to the movable tubular members, and control means arranged so as to permit a conjoint height-adjustment of the two table top portions (A,B) or a separate height-adjustment of one of the two table top portions (A,B) relative to the other.

3 Claims, 4 Drawing Sheets

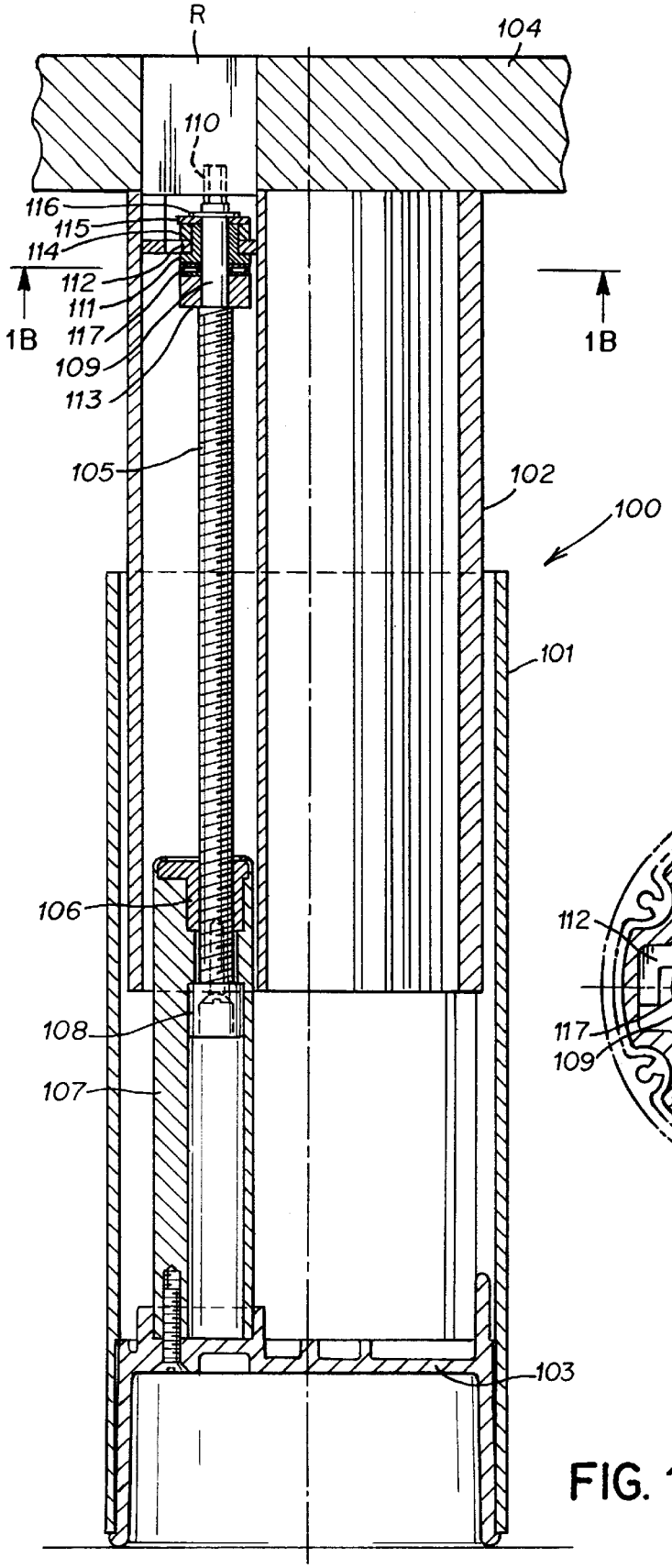
FIG. 1A
FIG. 1B
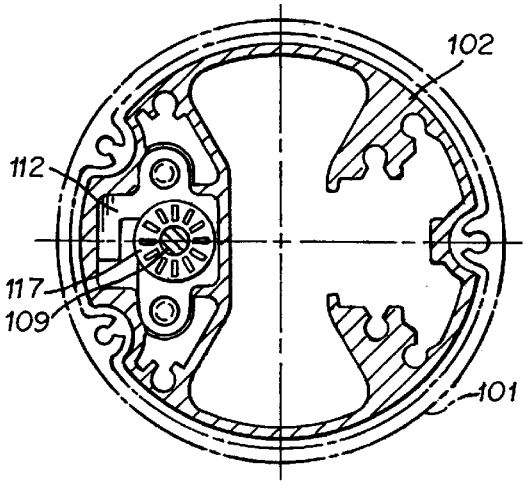

TABLE WITH ADJUSTABLE TABLE TOP PORTIONS

BACKGROUND OF THE INVENTION

This invention generally relates to the field of furniture pieces and, in particular, tables with height-adjustable table top.

DESCRIPTION OF THE PRIOR ART

Recent years have witnessed a continuous and gradual development in the field of furniture pieces aimed at making furnitures more corresponding to the requirements of the users.

In the field of office furnitures, this development has concerned chiefly tables. In particular, there are known in the art tables having a table top which is adjustable in height and/or inclination. In one of their essential embodiments, these tables are provided with a control mechanism which is preferably manually operable and permits the table working surface to be raised, lowered and inclined by the user in a stepless manner and according to his requirements.

The developments in tables have also concerned the field of home furnitures. In particular, as regards kitchen furniture pieces, there are known tables or similar furniture pieces provided with height-adjustable table tops.

Although the mechanism for adjusting the working surface of the table permits a greater convenience of use to be achieved, it has been found that such a control mechanism is not very suitable in the case the table must also support objects which require to be located in positions more easy to reach or, in the case of working tables, when the table must support a computer terminal or a desktop computer.

In regard to working tables only, relatively recent studies in human engineering have in fact shown that the terminal or computer video display should ideally be located in an elevated position with respect to the table working surface so as to be at almost the same height of the user's eyes when he is seated at the table. For such a reason, there have been devised tables having two table top portions, one of which is a working surface, while the other is a supporting surface for the video display of a computer terminal or a desktop computer. However, each of these table top portions is arranged in a fixed position and in a parallel and horizontally staggered relationship with respect to the other. The lower portion of the table is used as a traditional working surface and is intended to support thereon a terminal or computer keyboard, whereas the upper portion is intended for supporting the video display, possibly together with the printing unit.

The tables of the above mentioned kind offer some advantages in terms of comfort and usefullness. As a matter of fact, these tables permit the computer terminal to be integrated in a much more ergonomic manner than the tables having a single table top portion even if adjustable in height and permit the user to organize in a rational manner the working area at his disposal. Nevertheless, these tables have the disadvantage of not permitting a separate height-adjustment of the two table top portions precisely because these two portions have a fixed position. Therefore, the user cannot completely adapt the table to his comfort requirements.

SUMMARY OF THE INVENTION

The present invention is aimed at obviating this disadvantage by providing a table provided with a height-adjustable table top formed of two portions which permits, apart from an adjustment in height of the table top portion acting as working surface, an height-adjustment of the portion acting as a support for objects which require to be located in a more convenient position in terms of functionality, as for example a desktop computer.

More in particular, the table according to the present invention is of the kind having a table top formed of two portions, one intended for use as a working surface and the other for use as an additional supporting surface, and at least one vertical member for supporting the table top, and is characterized in that:

- the table top portions intended for use as a working surface and as an additional supporting surface, respectively, are adjustable in height conjointly or separately, and
- the vertical support member for supporting the table top comprises:
- at least two tubular members arranged one into the other so as to be axially movable relative to each other, one of said tubular members being stationary and adapted to rest onto the ground and the other being movable and directly or indirectly connected to the table top portion intended for use as a working surface and/or to the table top portion intended for use as an additional supporting surface,
- drive means adapted to impart an axial motion to the movable tubular member(s), and
- control means adapted to operate the drive means in order to permit the user to perform a conjoint height-adjustment of the two table top portions or a separate height-adjustment of one of the two table top portions relative to the other.

BRIEF DESCRIPTION OF THE DRAWINGS

FIGS. 1A and 1B show a longitudinal sectional view and a transverse sectional view taken along line 1B—1B of FIG. 1A, respectively, of a first vertical support member for supporting a table top according to the invention.

DESCRIPTION OF THE PREFERRED EMBODIMENTS

Figure 2A:
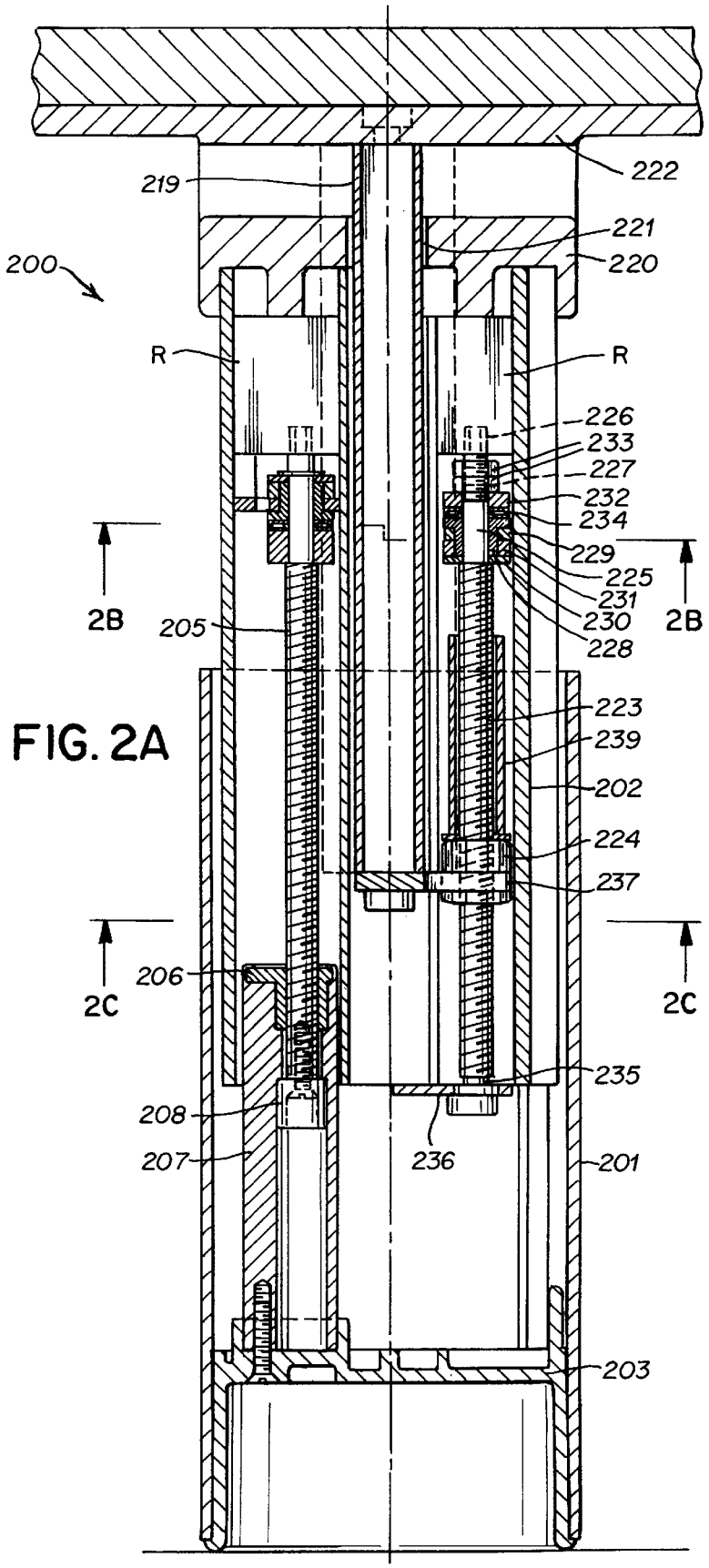
FIGS. 2A, 2B and 2C show a longitudinal sectional view, a transverse sectional view taken along line 2B—2B of FIG. 2A and a transverse sectional view taken along line 2C—2C of FIG. 2A, respectively, of a second vertical support member for supporting the table top according to the invention.

In the following, for the sake of simplicity and briefness of the description, the term "table leg" generally designates a vertical support member of the table top according to the present invention and will be described in two preferred embodiments thereof.

Table Leg of the First Embodiment

Referring to FIGS. 1A and 1B of the drawings, there is shown a first embodiment of the table leg according to the present invention. The leg, generally designated by 100, is formed of two vertical tubular members 101 and 102 arranged one into the other so as to be reciprocally movable in the axial direction.

The tubular member 101 is fixed. Its lower end portion is closed by a bordered plate 103 acting also as supporting base for the leg 100, whereas its upper end portion is open and the tubular member 102 projects therefrom.

The tubular member 102 is movable along the axial direction. Its lower end portion has an aperture, whereas its upper end portion is connected to a support and connecting plate 104.

The drive mechanism for the vertical motion of the tubular member 102 is formed of a vertical lead screw 105 which is rotated in a nut screw 106 inserted in upper end portion of a vertical tube 107 attached to the bordered plate 103.

The lead screw 105 is provided with a stop 108 at its lower end portion for preventing it to be removed from the tube 107 and with an unthreaded portion 109 and an hexagonal head 110 at the upper end portion. The unthreaded portion 109 of the lead screw 105 is rotatably supported by a plain bearing 111 arranged in a support 112 which is connected to the tubular member 102. The plain bearing 111 is retained around the unthreaded portion 109 from below by means of a first spacer 113 and from above by means of a second spacer 114, a washer 115 and finally a retaining ring 116. A thrust bearing 117 is interposed between the plain bearing 111 and the spacer 113.

For the rotation of the lead screw 105 a driving gear 118 (see FIG. 3) with orthogonally intersecting axes is provided in a housing R in the support and connecting plate 104. The driven wheel of the driving gear 118 is coupled to the hexagonal head of the lead screw 105.

Since the nut screw 106 is stationary, the rotation of the lead screw 105 with respect to the nut screw 106 is associated with a vertical motion of the former in the tube 107 and therefore with a vertical motion of the tubular member 102.

Table Leg of the Second Embodiment

Figure 2B:
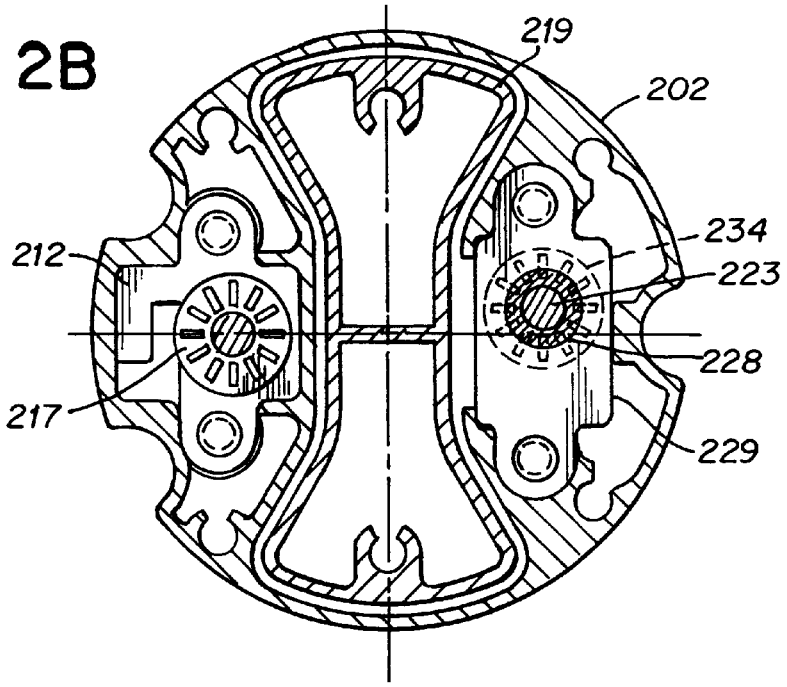
Figure 2C:
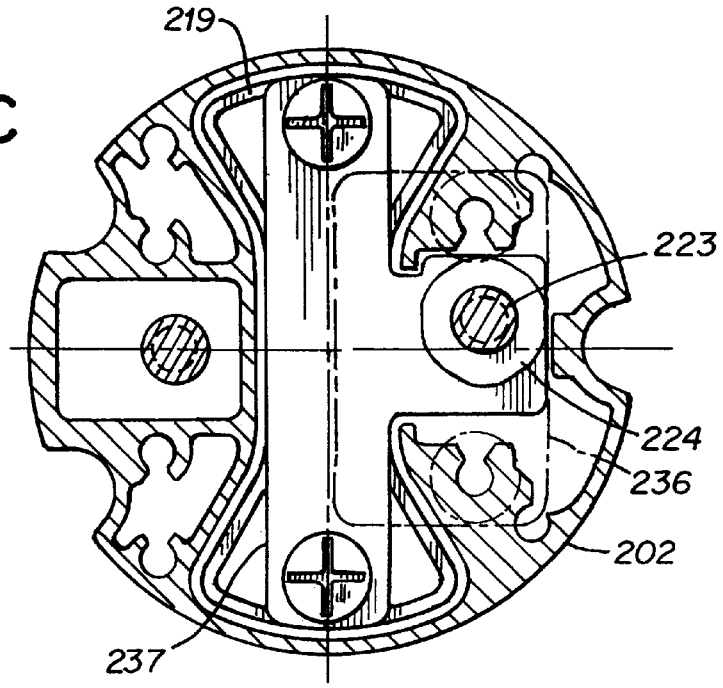

FIGS. 2A, 2B and 2C show a longitudinal sectional view and a cross sectional view taken along two different lines 2B—2B and 2C—2C, respectively, of a second embodiment of table leg. For the sake of semplicity and briefness of the description, all the parts corresponding in configuration and function to parts of the first embodiment of the table leg are designated by the same numeral increased by one hundred.

The table leg, generally indicated by 200, is formed of three vertical tubular members 201, 202 and 219 instead of two as in the first embodiment. These vertical members 201, 202 and 219 are arranged one into the other so as to be reciprocally movable in the axial direction.

The upper end portion of the tubular member 202 is connected to a support member 220. This support member 220 has an opening 221 through which the tubular member 219 can extend. A support and connecting plate 222 is connected to the upper end portion of the tubular member 219.

The table leg 200 embodies two drive mechanisms instead of only one, because in this case there are two tubular elements which are movable in the axial direction, namely the tubular member 202 and the tubular member 219.

The first drive mechanism, which is substantially similar to that embodied in the table leg 100, is formed of a vertical lead screw 205 and a nut screw 206, and is intended for the vertical motion of the tubular element 202. For the rotation of the lead screw a driving gear 218 (see FIG. 3) with orthogonally intersecting axes is provided in a housing R in the tubular member 202. The driven wheel of the driving gear 218 is coupled to the hexagonal head 210 of the lead screw 205.

The second drive mechanism is formed of a vertical lead screw 223 and a nut screw 224 and is intended for the vertical motion of the tubular member 219. The lead screw 223 comprises a unthreaded portion 225 and an hexagonal head 226 in the upper end portion. The unthreaded portion 225 and the hexagonal head 226 are separated by a short threaded portion 227. The unthreaded portion 225 is rotatably mounted in a plain bearing 228 which is housed in a support element 229 connected to the tubular element 202. The plain bearing 228 is retained around the unthreaded portion 225 of the lead screw 223 from below by means of a washer 230 and a first spacer 231 and from above by means of a second spacer 232 which is pressed against the plain bearing 228 by means of a pair of nuts 233 screwed onto the short threaded portion 227 of the lead screw 223. A thrust bearing 234 is interposed between the plain bearing 228 and the spacer 231. In its lower end portion, the lead screw 223 comprises a unthreaded portion 235 which is rotatably supported by a support 236 connected to the tubular member 202. The nut screw 224 is connected to the lower end portion of the tubular member 219 by means of a support member 237.

For the rotation of the lead screw 223 a driving gear 238 (see FIG. 3) with orthogonally intersecting axes is provided in a housing R inside the tubular member 202. The driven wheel of the driving gear 238 is coupled to the hexagonal head 226 of the lead screw 223. Since the nut screw 224 is movable, the rotation of the lead screw will impart a motion to the nut screw 224 together with the tubular member 219.

The full travel of the nut screw 224 is restricted by a tubular stop in which the lead screw 223 is inserted. During the rotation of the lead screw 223, the tubular stop 239 is pushed up by the nut screw until it abuts the washer 230.

Example of Use

For exemplificatory purposes, a table having a top supported by table legs of the kind described above will now be illustrated. The table herein described is of the so called "corner" kind because the table top is so formed as to at least partially embrace the user.

Figure 3:
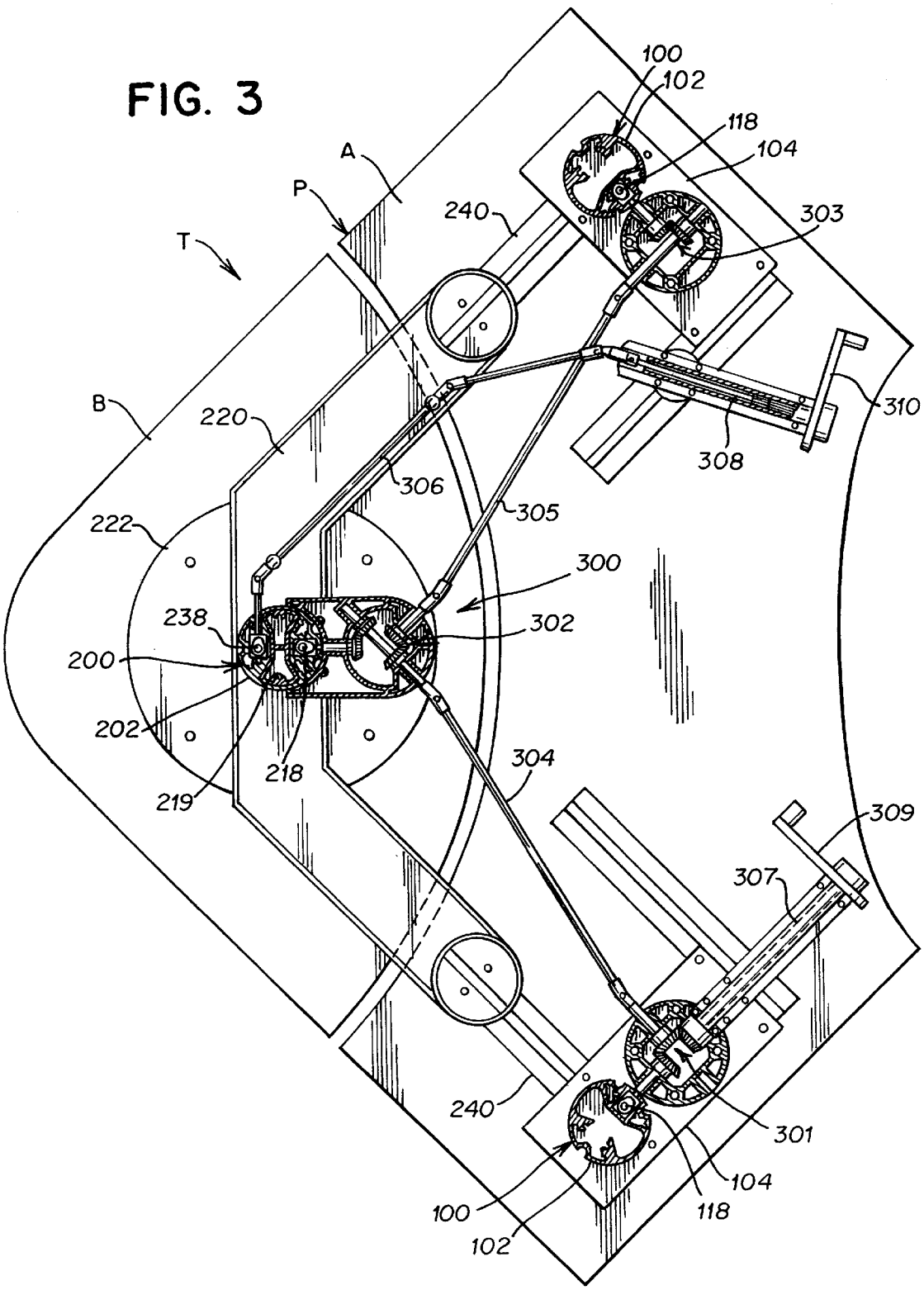
FIG. 3 is a cross-sectional plane bottom view of the height-adjustable table according to the invention with a table top formed of two portions one of which is supported by two vertical support members as described with reference to FIGS. 1A and 1B and the other is supported by a third vertical support member as described with reference to FIGS. 2A, 2B and 2C.

Referring to FIG. 3, there is illustrated a plan bottom view of the corner table, generally indicated with T and comprising a table top P formed of two portions A and B, the first of which really acts as a working surface, whereas the second, located at the corner, is typically intended for supporting the video display of a computer terminal or of a desktop computer in an elevated or lowered position with respect to the working surface.

The table top P is supported by three table legs, two of which are laterally arranged and one of which is center arranged. The two lateral table legs are as that designated by 100 in the first embodiment, while the central table leg is as that designated by 200 in the second embodiment.

The table top portion A is connected to the support member 220 attached to the upper end portion of the tubular element 202 of the central table leg 200, while the table top portion B is connected to the support and connecting plate 222 attached to the tubular element 219 of the central table leg 200.

The support member 220 is provided with two extensions 240 to the end of which the support and connecting plate 104 connected to the upper end portion of the tubular member 102 of the lateral table leg 100 is fixed.

FIG. 3 also illustrates the control mechanism used for actuating the screw mechanisms which are embodied in the lateral and central table legs 100 and 200. The control mechanism, generally indicated by 300, comprises three bevel gearings 301, 302 and 303, two intermediate shafts

304 and 305, an articulated intermediate shaft 306 and two drive shafts 307 and 308. The intermediate shafts 304 and 305 transmit motion from the bevel gearing 301 to the bevel gearing 302 and from the latter to the bevel gearing 303 and the drive shafts 307 and 308 are manually operable by the user by means of crank handles 309 and 310, respectively.

Each of the bevel gearings 301 and 302 is associated with the driving gear 118 of the relevant lateral table leg 100, while the bevel gearing 302 is associated with the driving gear 218 of the central table leg 200. The driving gear 238 of the central table leg 200 is instead directly associated with the articulated intermediate shaft 306.

The drive shafts 307 and 308 are telescoped so that their crank handles 309 and 310 may be kept out of sight during normal use of the table and pulled out from below the table top P when height adjustments thereof are required.

Operation of the control mechanism 300 is the following. By operating the handle 309, the user can adjust the height of the table top P as a whole. In fact, the control mechanism transmits the control motion at the same time to all the table legs 100 and 200 of the table T. By rotating the handle 310, the user is capable of adjusting the height of the table top portion B only. In fact, the control mechanism 300 transmits the control motion to central table leg 200 only. In particular, the table portion B can be raised or lowered with respect to the table top portion A.

The advantage offered by a double adjustment of the table top P can be clearly seen; as a matter of fact, it permits the user to adjust the height of the table top portions A and B in order to satisfy its comfort requirements in a most complete manner.

It can be also noted that the adjustment by means of a screw mechanism is extremely accurate.

Of course, the configuration of the table legs 100 and 200 and their supports is given only for explanatory purposes and may vary according to the kind of table, and also the configuration of the control mechanism 300 may vary in order to result operatively the most effective.

It should be understood that the corner configuration of the table has been given by way of example only and that the table may assume any configuration according to the purpose for which it is intended. Also the drive shafts of the control mechanism may be powered by electrical motors instead of crank handles.

What is claimed is:

1. A table having a table top formed of two portions, a first portion intended for use as a working surface and a second portion for use as an additional supporting surface, and at least one vertical support member for supporting the table top, wherein in order to permit the first and second portions to be respectively adjusted in height, the vertical support member for supporting the table tope comprises:

at least three tubular members arranged one into the other so as to be axially movable relative to each other, a first one of said tubular members being stationary and adapted to rest onto ground, a second one of said tubular members being movable with respect to said first one of said tubular members and connected to the first portion intended for use as a working surface, and a third one of said tubular members being movable with respect to the second one of said tubular members and connected to the second portion for use as a additional supporting surface, a drive mechanism adapted to impart an axial motion to the second and third movable tubular members, and a control mechanism adapted to operate the drive mechanism in order to permit a user to perform a conjoint adjustment of a height of the first and second portions or a separate adjustment of the height of the first portion relative to the second portion, wherein the second portion may be adjusted so as to be at a height above the first portion, at a same height as the first portion, and at a height below the first portion;

wherein said drive mechanism adapted to impart an axial motion to the movable tubular members is included in the vertical support member;

wherein said control mechanism adapted to operate the drive mechanism associated with said drive mechanism through driving gears;

wherein said drive mechanism is formed of a screw mechanism and the control mechanism is formed of drive shafts which are operable by crank handles; and wherein a screw mechanism is provided for the axial motion of each of the second and third tubular members.

2. Table according to claim 1, wherein the second and third tubular members are respectively connected to the first and second portions by support and connecting plates.

3. Table according to claim 1, wherein said drive shafts of the control mechanism are actuated by electric motors.

* * * * *